US005086604A

United States Patent [19]

Orth

[11] Patent Number: 5,086,604

[45] Date of Patent: Feb. 11, 1992

[54] MOUNTING FOR STORM WINDOWS

[76] Inventor: Robert W. Orth, 1073 Burns St., St. Paul, Minn. 55106

[21] Appl. No.: 611,486

[22] Filed: Sep. 24, 1990

[51] Int. Cl.[5] ..... E06B 3/26

[52] U.S. Cl. ..... 52/741; 52/202

[58] Field of Search ..... 52/746, 745, 741, 202

[56] References Cited

U.S. PATENT DOCUMENTS

| | | | |
|---|---|---|---|
| 3,023,464 | 3/1962 | Zerbe | 52/202 |
| 3,992,815 | 11/1976 | Potter | 49/62 |
| 4,233,790 | 11/1980 | Meadows . | |
| 4,355,676 | 10/1982 | Lee . | |
| 4,399,640 | 8/1983 | Porter . | |
| 4,409,758 | 10/1983 | Dickerson . | |
| 4,441,290 | 4/1984 | Abel . | |
| 4,452,020 | 6/1984 | Werner | 52/202 |
| 4,733,510 | 3/1988 | Werner | 52/202 |

*Primary Examiner*—John E. Murtagh

*Attorney, Agent, or Firm*—Jacobson & Johnson

[57] ABSTRACT

A storm window assembly is described including a retainer member which has a ridge along its length and is permanently affixed to an existing window casing and a frame member which has a channel for glazing and a channel for snap-accepting the ridge on the retainer member and a cover frame. The frame member can pivot relative to the retainer member to allow mounting on non-vertical casings. The ridge on the retainer member has a tip thereon to restrict the amount of pivoting permitted between the frame member and retainer member.

1 Claim, 3 Drawing Sheets

MOUNTING FOR STORM WINDOWS

BACKGROUND OF THE INVENTION

The invention disclosed relates to the retrofit market for both home and commercial use. With increasing energy costs and the high cost incurred In replacing your prime windows, the need for a long lasting, high quality third insulating storm has become imperative.

The objective of the invention is to make a custom built third insulating snap-on storm panel for interior or exterior application, who's design is easy to install (one step process), adapts to all window casing and sill applications, adds aesthetic beauty to the home, and is designed structurally to last a lifetime.

There have been many inventions which have utilized some type of snap-on systems over the last fifteen years (Werner U.S. Pat. No. 4,452,010), Werner (U.S. Pat. No. 4,733,510), Porter (U.S. Pat. No. 4,399,640), and Meadows (U.S. Pat. No. 4,233,790). All of the above system's designs encompassed long difficult installation processes which included separating the male and female member from each other, laying each track separately onto the window casing, then nailing the tracks into place, and then re-snapping the main frame back together with the secure male or female unit on the window casing. If the tracking system is not perfectly aligned to the dimensions of the main frame receiver, the main frame will not snap back into the tracking system correctly upon completion of the installation causing air infiltration through the main frame, and damage to the tracking system due to misalignment.

For existing window will applications, the Werner design (U.S. Pat. No. 4,452,020) shows a vinyl adapter bar which is permanently secured into the existing window sill to create a surface to secure his tracking system onto. The bar is unsightly when the main frame is removed from the sill and also gathers dust and dirt. Werner (U.S. Pat. No. 4,733,510), Porter (U.S. Pat. No. 4,399,640) and Meadows (U.S. Pat. No. 4,233,790) show no method for sill applications.

For aesthetic beauty and protection of the retainer structure when the main frame is removed, Werner (U.S. Pat. No. 4,452,020) also shows a cap which fills the retainer. However, although the cap keeps out dirt and debris, the cap provides no protection to the female retainer from ultraviolet rays from the sun. Porter, Meadows and Werner (U.S. Pat. No. 4,733,510) are all without collars or covers for protecting their retainer structure when the main frame assembly is removed. This is important because exposure of the vinyl material of the retainer structure to the sun's ultraviolet rays results in accelerated degradation of the plastic vinyl material. This reduces the resiliency of that material so that it becomes more prone to cracking; which requires replacement of the tracking system, at additional expense, when it occurs.

The proceeding invention overcomes the above mentioned shortcomings encountered by past snap-on inventions.

SUMMARY OF THE INVENTION

This invention provides a storm window assembly which is inexpensive to produce, east to install, and has an extruded retainer member which does not accumulate dirt and debris by virtue of a unique and esthetically pleasing cover that is used when the frame is not in place. Additionally, this invention provides a storm window assembly which allows installation of the assembly on an existing window having a non-vertical casing without shortening the useful life of the frame member.

The invention includes an extruded retainer member which is permanently affixed to the casing of an existing window and which has a ridge running its length onto which is snapped the channel of an extruded frame member, forming a weather tight seal. The frame member has an additional slot for securing window glazing within the frame. The ridge on the retainer member has a neck, a bulb and a tip. The channel on the frame member is formed by two flanges which are flexible to an extent and shaped so as to snap over the bulb on the ridge. A gap between the ends of the flanges forming the channel and the neck of the ridge allows the frame member to pivot relative to the retainer member. Since the tip of the ridge on the retainer member will contact the inner surface of the channel in the frame member, the amount of pivoting is restricted. The ridge on the retainer member is therefore designed to allow for restricted pivoting between the frame member and the retainer, thus preserving the desired mountability on existing window casings with non-vertical surfaces but preventing undesirable stress and strain on the frame member during the installation. Further, when no storm window is needed, a unique frame member having no glass may be added thereby enhancing the life of the invention and the inventions esthetic value as well.

Also, when the window to which the storm window is attached has a sill a sill channel may be incorporated into the storm window structure. The sill channel that is incorporated in the storm window comprises a channel, normally located at the base of the storm window having at least two flanges defining its shape. The space between these two flanges is filled with weather strip material which is permanently attached to the sill channel. This allows for a good seal on all window sills regardless of whether or not they are uneven or warped.

Other advantages of this invention will become apparent to those skilled in the art upon consideration of the accompanying specification, claims and drawings.

DETAILED DESCRIPTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 2:
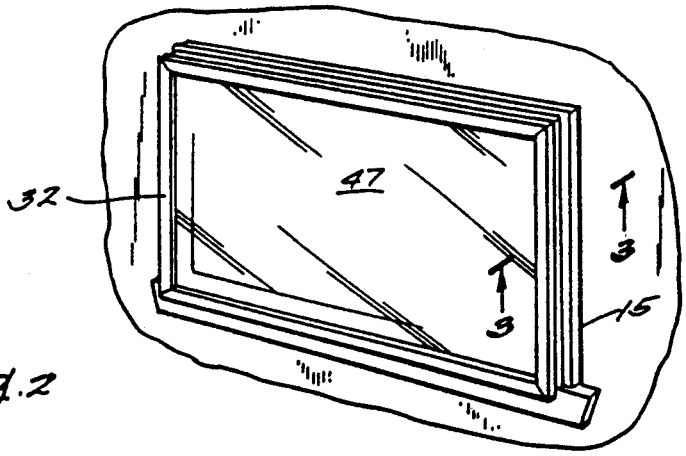
FIG. 2 is a perspective view of a storm window mounted in place on a window casing.
Figure 5:
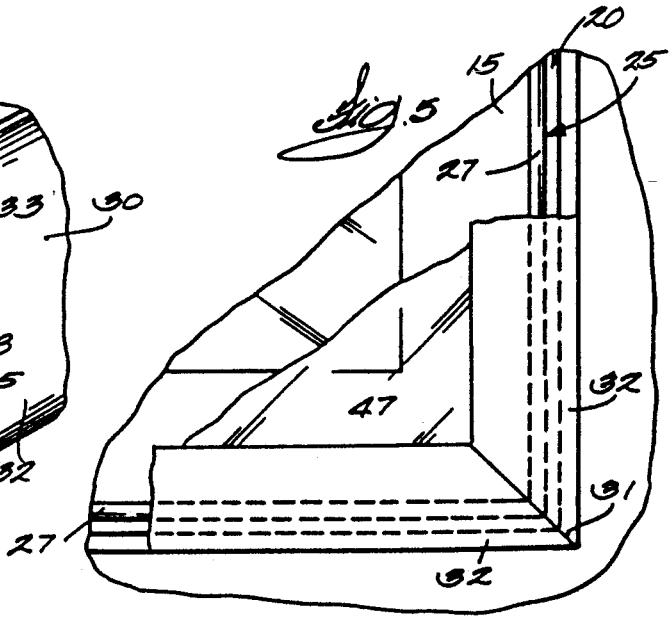
FIG. 5 is a front view of the corner of a window casing and my storm window with the remainder broken away to show the underlying portion of the mounting.
Figure 6:
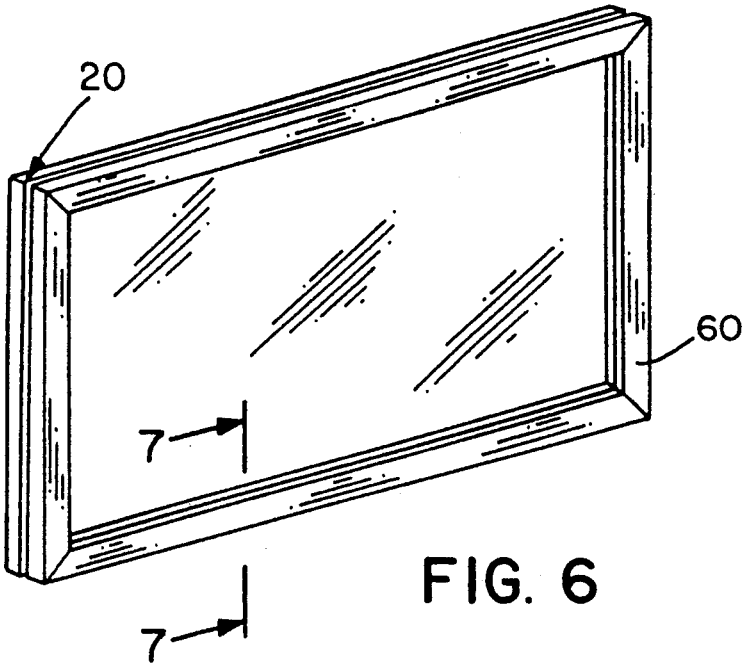
FIG. 6 is a perspective view showing the cover attached to the retainer.
Figure 7:
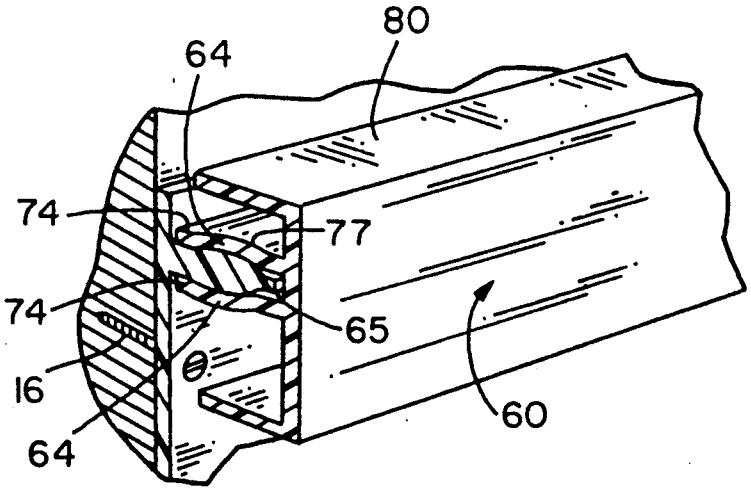
FIG. 7 is a view from line 7—7 of FIG. 6.

Referring to FIGS. 2 and 5, this invention begins with a conventional glass window in a conventional window casing 15. Throughout this description and the claims that follow, the term "casing" is used to refer to the mounting surface of the existing window, including the casing, frame, trim or molding.

An extruded male retainer 20 is permanently attached to a window casing 15 preferably by means of a dual-sided pressure-sensitive foam tape adhesive (not shown). Nails 16 may be used to further assure adhesion. The retainer 20 has a base 22 and a ridge 25 which run its length. The ridge 25 has a neck 26, a bulb 27 and a tip 28.

Figure 4:
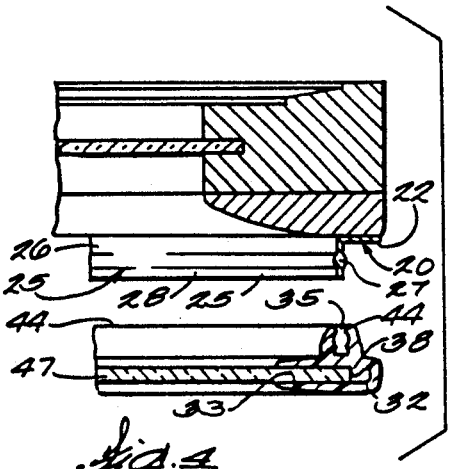
FIG. 4 is a view similar to FIG. 3 but exploded to show the storm window portion of the mounting removed a slight distance from the window casing portion of the mounting.
Figure 3:
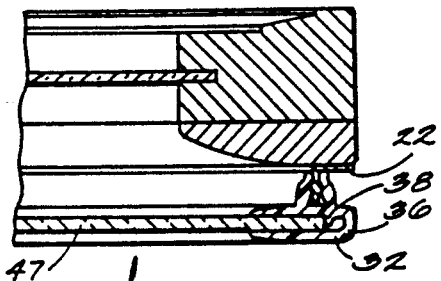
FIG. 3 is a cross sectional view on Line 3—3 of FIG. 2.

Storm window frame 30, which is illustrated as rectangular but can be made to coincide with the shape of any window, is made of extruded side members 32 the ends of which are mitered to form the corners 31 of the storm window frame 30. As illustrated in FIG. 4, each extruded side member 32 of the storm window frame 30 has a slot 33 to hold window glazing 47 in place. A flexible ledge 38 in the slot 33 prevents the window glazing 47 from being inserted to the bottom of the slot 33. This creates a space 49 at the bottom of the slot 33 which provides room for expansion of the window glazing 47 due to extreme temperature changes. The space 49 also extends upwardly between the outside surface 48 of the glazing 47 and one of the extruded side members 32. Accordingly space 49 allows the glazing 47 to be able to pivot slightly within the slot 33. This also reduces stress on the glazing 47. Further the space 49 allows the storm window flexibility to effectively snap back into the retainer means on both curved molding applications and uneven casings without creating stress to the main frame, retainer means, or glazing. Further, the storm window 30 has two somewhat flexible extruded flanges 34 which form a channel 35. The distance between the ends 44 of the flanges 34 is less than the width of the bulb 27 of the ridge 25. The distance between the curved inner surfaces 47 of the flanges 34 is also less than the width of the bulb 27 of the ridge 25, but greater than the distance between the ends 44 of the flanges 34. During installation, the channel 35 of the frame 30 is pressed against the ridge 25 of the retainer 20. The ends 44 of the flanges 34 contact the bulb 27 of the ridge 25 causing the flanges 34, which are flexible to an extent, to spread. When the ends 44 of the flanges 34 pass beyond the bulb 27 and reach the neck 26 of the ridge 25, the flanges 34 contract, until the curved inner surfaces 47 of the flanges 34 contact the bulb 27 of the ridge 25 so as to provide a good air seal. The contact between the curved inner surfaces 47 of the flanges 34 and the bulb 27 of the ridge 25 also prevents the ends 44 of the flanges 34 from coming in contact with the neck 26 of the ridge 25 thereby creating a gap 59. When performed quickly, the channel 35 "snaps" over the ridge 25. The channel 35 of the storm window frame 30, therefore, snaps over the ridge 25 of the retainer 20 for the length of the frame 30 so that the frame 30 is retained against the window casing 15 providing a good air seal and thus good insulation. Desirably bulb 27 is somewhat oval in cross-section, as best shown in FIG. 1, to limit pivoting while sealing well.

Figure 1:
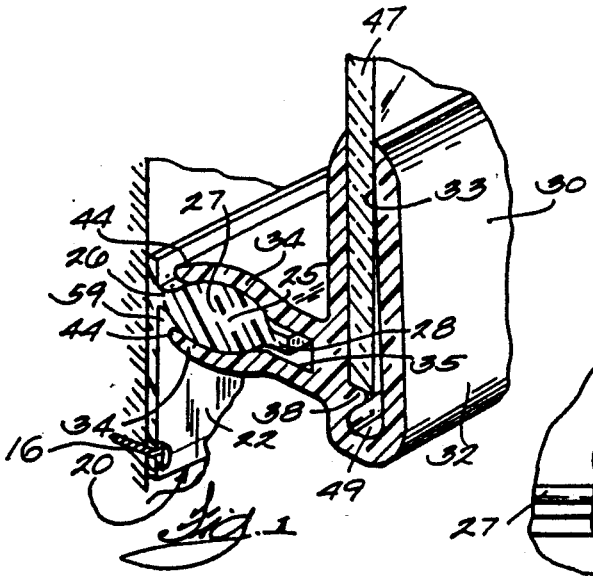
FIG. 1 is a greatly enlarged cross sectional view through the storm window mounting of my device.

Referring now to FIG. 1, when a storm window frame 30 is snapped over the retainer 20 a gap 59 is formed between the ends 44 of the flanges 34 which form the channel 35 and the neck 26 of the ridge 25. This gap 59 allows the frame 30 to pivot with respect to the retainer 20. The flexibility of flanges 34 also helps. Consequently, the retainer 20 can be mounted on surfaces which are to a certain degree not parallel to the existing window. The tip 28 of the ridge 25, however, limits the amount of pivoting allowed by contacting the inside of the channel 35.

Frequently when the storm window frame 30 is installed on the retainer 20 initially one side member 32 is snapped onto the corresponding retainer 20 which is mounted on the horizontal portion 15 of the casing 15. The other sides of the frame 30 are then snapped into place by pivoting the frame 30. In some situations, the horizontal portions and vertical portions of the casing 15 are not precisely co-planar (i.e., the casing 15 is not parallel to the existing window 17). Where this is the case, much stress is experienced at corner 31 during installation. Increased deviation from co-planarity increases the stress experienced by corner 31. By limiting the degree of pivoting of the frame 30 relative to the retainer 20, the present invention places a limit on the amount of stress imposed on corner 31, and thereby tends to increase the useful life of the frame 30.

The frame 30 can be removed when a storm window is not needed. Margin 36 provides a convenient handle by which the frame 30 can be pulled from the retainer 20. When the frame 30 is not in place, the retainer 20 remains permanently affixed to the casing 15. Retainer 20 has a ridge, but no exposed channel, and thereby prevents the accumulation thereon of any significant amount of dirt or debris which might result from exposure to the elements. However in order to further minimize the amount of dirt or debris that could possibly accumulate on the retainer 20, a cover 60 is used. The cover 60 is attached to the retainer 20 in the same manner as a storm window frame 30 is attached. Like the storm window frame 30 the cover 60 has two flanges 64 which are flexible to a certain extent. The flanges 64 has ends 74. The distance between the ends 74 of the flanges 64 is less than the width of the bulb 27 of the ridge 25. The flanges 64 also have curved inner surfaces 77. The distance between the curved inner surface 77 of the flange 34 is less than the width of the bulb 27. However this distance is greater than the distance between the end 74 of the flanges 64. The space between the flanges 64 is called the channel 65. During installation, the channel 65 of the cover 60 is pressed against the ridge 25 of the retainer 20. The end 74 of the flanges 64 contact the bulb 27 of the ridge 25 causing the flanges 64 to snap over the bulb 27 and reach the neck 26 of the ridge 25. This leaves the curved inner surfaces 77 of the flanges 64 in contact with the bulb 27 of the ridge 25.

The cover 60 is further comprised of two flanges 80 and 81. These 80 and 81 act as shields which cover the retainer 20. These flanges 80 and 81 provide a smooth surface that is esthetically pleasing to the eye. Therefor when the cover 60 is snapped onto the retainer 20 the effect created is that of a smooth, clean looking window frame. This enhances the beauty of the window and prevents the accumulation of dust or debris on retainer 20.

Figure 8:
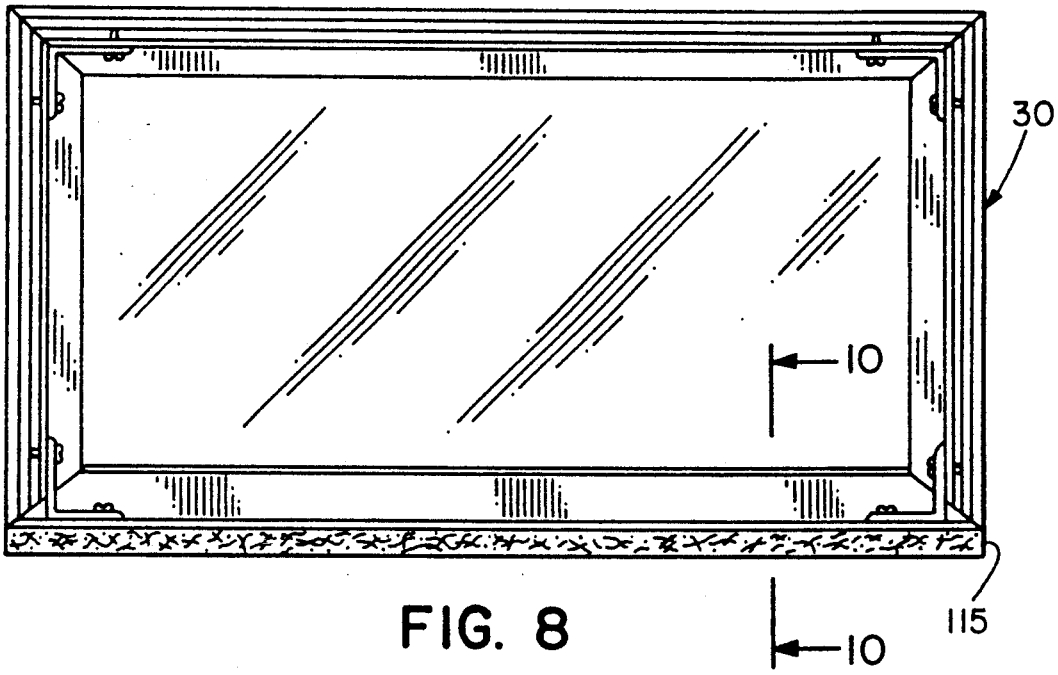
FIG. 8 is a front elevational view showing the storm window with the sill channel.
Figure 9:
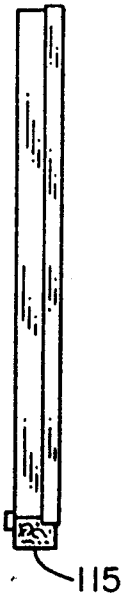
FIG. 9 is a side elevational view showing the storm window with the sill channel.
Figure 10:
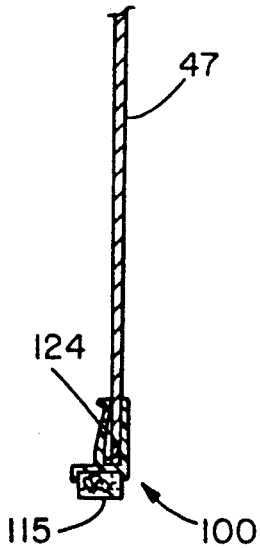
FIG. 10 is a view from line 10—10 of FIG. 9 and shows the storm window and the sill channel.
Figure 11:
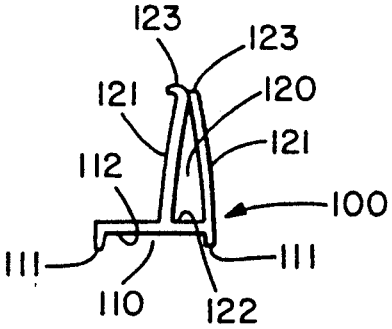
FIG. 11 is a side elevational view of the sill channel without glazing.

FIGS. 8 through 11 show an additional embodiment of the instant invention for your use in application where the storm window frame 30 must be mounted to a window having a sill. The sill channel 100 is an extruded structure having a weather stripping channel 110 and a glazing receiving channel 120. FIG. 11 shows a side elevational view of the sill channel 100. The weather stripping channel 110 is defined by flanges 111 and support portion 112. The glaze receiving channel 120 is defined by flanges 121 and bottom portion 122. Bottom portion 122 is integral with support portion 112. FIGS. 8 through 10 show various views of the sill channel 110 in combination with the glazing 47 and the weather stripping 115. As can be seen by comparing 10 and 11 the tips 123 of the flanges 121 touch each other prior to insertion of the glazing 47. As FIG. 10 illustrates the glazing 47 is inserted between the flanges 121. Flanges 121, like the extruded side members 32, are flexible and slightly biased towards one another so that they grip the glazing 47 when it is inserted between the flanges 121.

Once the glazing 127 is inserted between the flanges 121 a space 124 is formed as illustrated in FIG. 10. The space 124, like the space 49, provides for expansion of the glazing 47. Further, the space 124, like the space 49, allows the glazing 47 to pivot slightly within the glaze receiving 120. Further when the sill channel 100 is used in conjunction with sections of the storm window frame 30 which are to snap onto extruded male retainers 20 the space 124, like the space 49, working in conjection with the weatherstrip material, allows for weather tight applications on uneven or warped existing sill applications without creating extra stress to the sill channel or glazing material.

The foregoing is considered as illustrative only of the principles of the invention. Furthermore, since numerous modifications and changes will readily occur to those skilled in the art, it is not desired to limit the invention to the exact construction and operation shown and described.

What is claimed is:

1. A method for mounting a storm window and a decorative cover frame to a window casing so that storm window and the decorative cover frame can be interchanged comprising the steps of:

placing an extruded male retainer means around a window casing, the extruder male retainer means having an enlarged bulb with a convex outer surface, the extruded male retainer means having a ridge extending its entire length, the ridge having a relatively narrow neck adjacent the enlarged bulb to allow the enlarged bulb to flex with respect to the retainer means, the retainer means having an outwardly projecting integral strip projecting sufficiently beyond the enlarged bulb for receiving permanent attachment means for attaching the retainer means to the window casing;

inserting a channel of a storm window frame member in a pivoting relationship on the male retainer means by forcing the channel having engagement means for engaging only the enlarged bulb with a convex outer surface, onto the convex outer surface of the enlarged bulb to thereby permit the storm window frame member to pivot and flex to a limited extent with respect to the retainer means to facilitate application of the storm window frame member and the retainer means as an assembled unit to the window casing while the retainer means remains engaged with the storm window frame member;

permanently affixing the outwardly projecting integral strip to the window casing while the storm window frame member is pivotally mounted to the convex outer surface of the enlarged bulb of the retainer means by nailing the outwardly projecting integral strip to the window casing to thereby provide a permanent retainer means affixed around the window casing;

pulling the storm window frame member away from the enlarged bulb after the integral strip is affixed to the window casing to leave the retainer means secured to the casing with the enlarged bulb and the ridge exposed to view; and then applying a decorative cover frame to the enlarged bulb, the decorative cover frame having a first face with flanges projecting outward from a channel on the decorative cover frame, the decorative cover frame having no means for supporting a storm window to the retainer means but having means for engaging only the enlarged bulb of the retainer means around the convex outer surface of the enlarged bulb, by inserting the channel in the decorative cover frame having means for engaging only the enlarged bulb of the retainer means around the convex outer surface of the enlarged bulb until the enlarged bulb and the ridge are completely hidden from view by the flanges projecting outward form the decorative cover frame to thereby form a pivotally and locking engagement between the enlarged bulb and the channel in the decorative cover frame so that the decorative cover frame provides a decorative cover frame for completely hiding from view the enlarged bulb when the storm window frame member is not present so that the decorative cover frame adds a finished look to the male retainer means and protects the enlarged bulb and the ridge from exposure to the sunlight when the storm window frame member is not in place on the male retainer means.

* * * * *